United States Patent [19]

Fiocco

[11] Patent Number: 4,619,709

[45] Date of Patent: Oct. 28, 1986

[54] CHEMICAL TREATMENT FOR IMPROVED PIPE LINE FLUSHING

[75] Inventor: Robert J. Fiocco, Summit, N.J.

[73] Assignee: Exxon Research and Engineering Co., Florham Park, N.J.

[21] Appl. No.: 615,565

[22] Filed: May 31, 1984

Related U.S. Application Data

[63] Continuation of Ser. No. 386,705, Jun. 9, 1982, abandoned.

[51] Int. Cl.[4] ..... B08B 9/00

[52] U.S. Cl. ..... 134/22.14; 134/40

[58] Field of Search ..... 134/22.14, 40

[56] References Cited

U.S. PATENT DOCUMENTS

| | | | |
|---|---|---|---|
| 2,023,496 | 12/1935 | Todd | 134/40 X |
| 2,748,084 | 5/1956 | Lew et al. | 134/40 X |
| 2,937,112 | 5/1960 | Boyer | 134/40 |
| 3,436,263 | 4/1969 | Strenkert et al. | 134/40 X |
| 3,535,160 | 10/1970 | Arger | 134/40 X |
| 3,536,529 | 10/1970 | Fiocco | 134/40 |
| 3,793,218 | 2/1974 | Canevari | 252/312 |
| 4,033,784 | 7/1977 | Lawson et al. | 134/40 X |
| 4,233,174 | 11/1980 | Sheridan | 134/40 X |
| 4,256,610 | 3/1981 | Hwang | 134/40 X |

FOREIGN PATENT DOCUMENTS 917481 2/1963 United Kingdom .

*Primary Examiner*—Peter Hruskoci

*Attorney, Agent, or Firm*—Joseph J. Dvorak

[57] ABSTRACT

The present invention comprises a method for removing residual hydrocarbon fluids from pipe systems by contacting the hydrocarbon with a solution containing a hydrocarbon-stripping agent which is capable of decreasing the wetting characteristics of the residual hydrocarbon on the internal surfaces of the pipe system whereby the film retracts from the surface and forms droplets which are thereafter removed with the water solution. Specific hydrocarbon-stripping agents are disclosed.

6 Claims, 3 Drawing Figures

CHEMICAL TREATMENT FOR IMPROVED PIPE LINE FLUSHING

This is a continuation of application Ser. No. 386,705 filed June 9, 1982, now abandoned.

BACKGROUND OF THE INVENTION

1. Field of the Invention

This invention relates to a method of removing residual liquid hydrocarbons such as oil from pipe systems. More particularly, this invention relates to the flushing of residual amounts of oil, sediment and other impurities from pipe systems, particularly ballast discharge lines on board ships in which sea water is the principal fluid for flushing and/or after draining of such pipe systems.

2. Prior Art

Crude oil tankers normally use the same pumps and piping lines to handle both cargo and clean ballast water; therefore, tankers must effectively flush the crude oil from these lines during the ballast voyage in order to avoid contaminating water at the crude loading port environment during clean ballast water discharge at the port. This water flushing operation is very difficult and time-consuming because of the complexity of the piping network and the large number of deadended branches in the pipe system. Also, only very limited direct water flushings of discharge lines from cargo and clean ballast tanks occurs during crude oil tank cleaning operations. Typically, 2 to 4 hours of water flushing per day for several days must be dedicated to this cleaning operation to get the tanker pipe system sufficiently clean so that substantially no crude oil or other associated impurities will be released from the pipe system and discharged in port with the clean ballast water; and, despite such extensive cleaning operations, experience has shown that a gradual release of oil film can occur from dead-end piping sections and valves which can recontaminate the lines and subsequently the discharged ballast water. Thus, there remains a need for improved method for cleaning pipe systems, particularly oil tanker pipe systems, of residual amounts of hydrocarbons.

SUMMARY OF THE INVENTION

Simply stated, the present invention comprises a method for removing residual hydrocarbon fluids, such as crude oil from pipe systems, particularly pipe systems on tankers, by contacting a hydrocarbon film on the internal surfaces of said pipe systems with a water solution, especially a saline solution such as sea water, containing a hydrocarbon-stripping agent which is capable of decreasing the wetting characteristics of the hydrocarbon whereby the film retracts from the surface of the pipe and forms droplets and thereafter removing the hydrocarbon droplets with said water solution.

In one embodiment of the present invention, films and/or residual amounts of hydrocarbon fluids remaining within pipe systems are removed by intermittently flushing said pipe systems with a saline solution in which at least one of said saline solutions contains a hydrocarbon-stripping agent selected from (a) mixtures of $C_{10}$ to $C_{20}$ aliphatic carboxylic acids, sorbitan monoesters thereof, sorbitan monoacylates and polyoxyalkylene adducts of the sorbitan monoesters wherein said mixtures have an HLB number in the range of from about 5 to about 9, and (b) mixtures of $C_{10}$ to $C_{20}$ aliphatic carboxylic acids, sorbitan monoesters thereof, sorbitan monoacylates, polyoxyalkylene adducts of sorbitan monoesters wherein said mixtures include dialkyl sulfosuccinate salts preferably in amounts ranging from about 10% to 40% by volume of the mixture, and most preferably from about 30% to about 35% by volume of the mixture, said mixture in the absence of the dialkyl sulfosuccinate salt having an HLB number in the range of from about 9 to 12, and thereafter removing said saline solution from said system.

The important features of the present invention will be appreciated upon a reading of the specification in conjunction with the accompanying drawings.

BRIEF DISCUSSION OF THE DRAWINGS

DETAILED DESCRIPTION OF THE INVENTION

Figure 1:
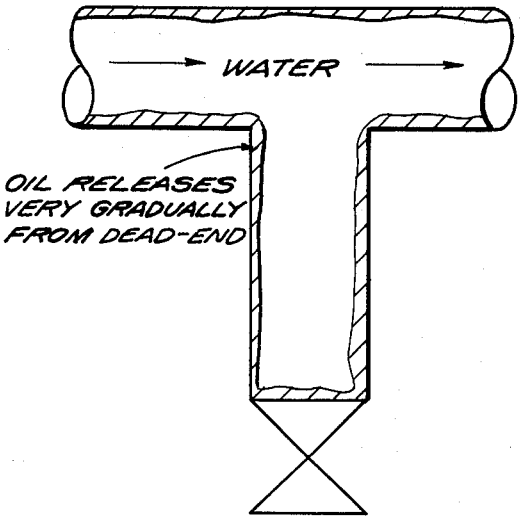
FIG. 1 is a pictorial illustration of an oil film which typically remains in a pipe system being flushed with water.

As indicated previously, pipe systems on board ships used to carry liquid hydrocarbons, such as crude oil, are cleaned by flushing the pipe system with sea water during the ballast voyage of the ship. This is a very time-consuming operation frequently with less than optimum results. Part of the reason for this is demonstrated in connection with FIG. 1. As can be seen in FIG. 1, crude oil tends to form a film on the interior surface of the pipe system which is not readily removed by repeated flushing of water through the pipe system. Indeed, as the pipes become rusty and/or otherwise corroded, the oil film tends to be even more adherent. Additionally, pipe systems have valves and other dead-end sections in which the flow of water does not reach. Thus, even after repeated water flushings of the pipe system, oil remains in the system which may be subsequently discharged during a later period with the potential that such discharge will enter the environment of a crude loading port.

The present invention comprises a method for removing residual hydrocarbon fluids, such as crude oil, from pipe systems by mixing a hydrocarbon-stripping agent with the water used to flush the pipe system. The hydrocarbon-stripping agent suitable in the practice of this invention is one which is capable of decreasing the wetting ability of the residual hydrocarbon in the pipe system so that the hydrocarbon "beads up" or retracts from the surface of the pipe system and preferably forms droplets which are released into the water solution containing the hydrocarbon-stripping agent. Among hydrocarbon stripping agents contemplated by the present invention are agents selected from (a) mixtures of $C_{10}$ to $C_{20}$ aliphatic carboxylic acids, sorbitan monoesters thereof, sorbitan monoacylates and polyoxyalkylene adducts of the sorbitan monoesters wherein said mixtures have an HLB number in the range of from about 5 to about 9, and (b) mixtures of $C_{10}$ to $C_{20}$ aliphatic carboxylic acids, sorbitan monesters thereof, sorbitan monoacylates, polyoxyalkylene adducts of sorbitan monoesters wherein said mixtures include dialkyl sulfosuccinate salts preferably in amounts ranging from about 10% to about 40% by volume of the mixture, said mixture without the dialkyl sulfosuccinate salt having an HLB number in the range of from about 9 to about 12, and thereafter removing said saline solution from said system.

The above mentioned carboxylic acids containing from about 10 to about 20 carbon atoms are straight or branched chain saturated or unsaturated acids. Preferred acids are straight chain saturated and monoethylenically unsaturated aliphatic monocarboxylic acids containing 12 to 18 carbon atoms. Representative acids include: capric acid, lauric acid, myristic acid, palmitic acid, margaric acid, stearic acid, oleic acid, elaidic acid, etc. These acids can be represented by the following general formula:

$$R—COOH$$

where R is a $C_9$-$C_{19}$ straight chain, branched chain or cyclic monovalent alkyl or alkenyl radical, preferably a straight chain alkyl or alkenyl radical.

The sorbitan monoesters of aliphatic carboxylic acids of the present invention are formed by the reaction of an aliphatic carboxylic long chain saturated or unsaturated fatty acid with a mixture of polyalcohols formed by the dehydration of sorbitol. The dehydration of sorbitol to the intermediate sorbitan compounds proceeds according to the following equations:

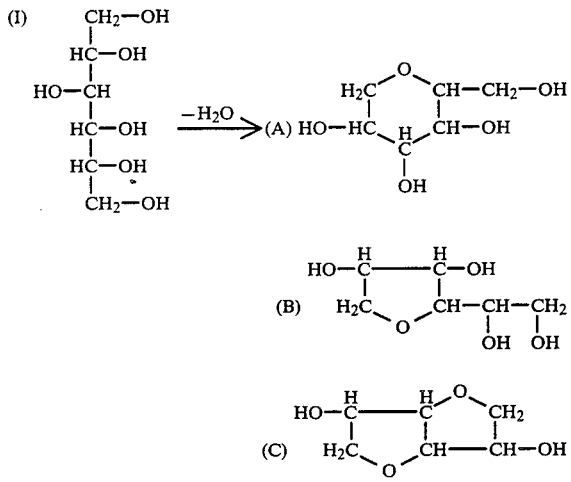

The above materials (products A, B and C) are all formed during the dehydration reaction.

Sorbitan monoesters are obtained by reacting Compound A, B or C, or their mixtures, with a fatty acid according to the following equations:

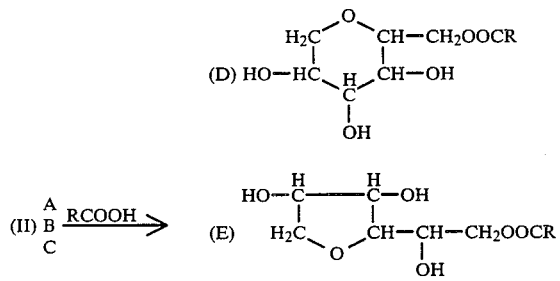

-continued

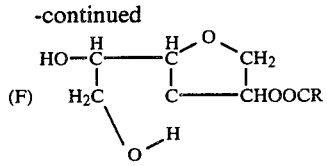

wherein R is as previously defined. As noted in Equation II, the esterification reaction involving a long chain monocarboxylic acid is quite specific as only certain of the available hydroxyl groups on the sorbitan material are subjected to the esterification reaction. The term "sorbitan monoacylate" as used herein is meant to denote Compounds D, E and F, alone or in admixture. These compounds may be represented by the general formula:

$$Y—O—\overset{\overset{\displaystyle O}{\|}}{C}—R$$

where R is as previously defined and Y is a monocyclic or bicyclic sorbitan radical (a sorbitan radical being defined as Compound A, B, C or their mixtures, the hydrogen atoms of one of the hydroxyl groups of the compounds being removed). Sorbitan monoester polyoxyalkylene adducts are formed by contacting sorbitan monoesters (Compound D, E or F or their mixtures) with a 1,2-alkylene oxide, thereby reacting one or more of the remaining hydroxyl groups from the sorbitan monoacylate to form compounds containing one or more polyoxyalkylene groups. When ethylene oxide is employed, the resulting polyoxyethylene groups have the structural formula $—(CH_2CH_2O)_nH$. When propylene oxide is used, the polyoxypropylene groups possess a structural formula:

$$-\left(\begin{array}{c} CH_2—CHO \\ | \\ CH_2 \end{array}\right)_m H$$

In the above structural formulas, n has a value in the range of 6 to 30, preferably 15 to 22, and m has a value in the range of 5 to 14. Since the polyoxyethylene and the polyoxypropylene radicals are polymeric products, a compound containing "n" ethylene oxide units or "m" propylene oxide units actually contains a fairly wide spectrum of groups with the numerical average being either n or m. The expression "polyoxyalkylene sorbitan monoacylate" is intended to encompass the polyoxyalkylene derivatives of Compounds D, E and F and their mixtures. These derivatives can also be defined as polyoxyalkylene adducts of $C_{10}$-$C_{20}$ aliphatic monocarboxylic acids in which the adduct has from 6 to 30 (preferably 15 to 22) polyoxyethylene units or from 5 to 14 polyoxypropylene units per mole of ester. These polyoxyalkylene sorbitan monoacylates are commercially available under various trade names. They may be denoted by the general formula:

$$R'—Y—O—\overset{\overset{\displaystyle O}{\|}}{C}—R$$

wherein R and Y are as previously defined and R' is a polyoxyalkylene radical, preferably a polyoxyethylene group having the general formula $—(CH_2CH_2O)_nH$ wherein n is from 6 to 30, preferably 15 to 22, or a polyoxypropylene group having the general formula:

$$-\left(\begin{array}{c} CH_2-CHO \\ | \\ CH_2 \end{array}\right)_m H$$

wherein m varies from 5 to 14. It is understood that the polyoxyethylene or polyoxypropylene radicals may be present on one or more of the available hydroxyl radicals of the cyclic compounds and, the values of n and m set forth above represent the average number of polyoxyethylene or polyoxypropylene groups present in the compound and not that the subject groups exist in one polymeric chain.

In addition to the foregoing structural features of the components of suitable hydrocarbon-stripping agents, the useful mixtures must have an HLB number in the range of from about 5 to about 9, or alternatively the mixture will contain a salt of a dialkyl sulfosuccinate wherein the alkyl group is a branched chain radical containing 8 or 9 carbon atoms. The preferred dialkylsulfosuccinate salt is sodium dioctyl sulfosuccinate, or more precisely, sodium di(2-ethylhexyl)sulfosuccinate. When the dialkylsulfosuccinate salt is present, it preferably is present in an amount ranging from about 10% to about 40% by volume, and most preferably from about 30% to about 35% by volume.

The HLB number used in connection with suitable hydrocarbon-stripping agents according to this invention refers to the well-known hydrophile-lipophile-balance number for oil and water emulsifiers. In this regard, see *Kirk-Othmer Encyclopedia of Chemical Technology,* Volume 8, page 131, published by John Wiley & Sons Inc. (1965) for an explanation of the HLB number.

Typically the hydrocarbon-stripping agent is mixed with a saline solution, such as sea water. In general, the amount of such agent employed in the practice of the present invention will be that sufficient to accelerate the rate of removal of residual hydrocarbon fluids from the pipe system. In.general, the amount of such agent suitable in the practice of the present invention will range from about 25 parts to about 1000 parts per million of stripping agent in the water used for flushing the system, and preferably from about 100 parts per million to about 300 parts per million of stripping agent.

Since it is preferred to mix the hydrocarbon-stripping agent with water, in those instances where the agent is sufficiently viscous so as to render the addition of the agent to and blending with water phase difficult, up to about 2 parts by volume of paraffinic solvents may be added to the agent to decrease the viscosity thereof and facilitate the blending with the aqueous phase. Suitable paraffinic solvents include isoparaffinic solvents available commercially under the ISOPAR trademark and aliphatic solvents containing ethyl alcohol, methyl isobutyl ketone and ethyl acetate and available commercially under the Trademark JAYSOL, each from Exxon Company, U.S.A., Houston, Tex.

Figure 2:
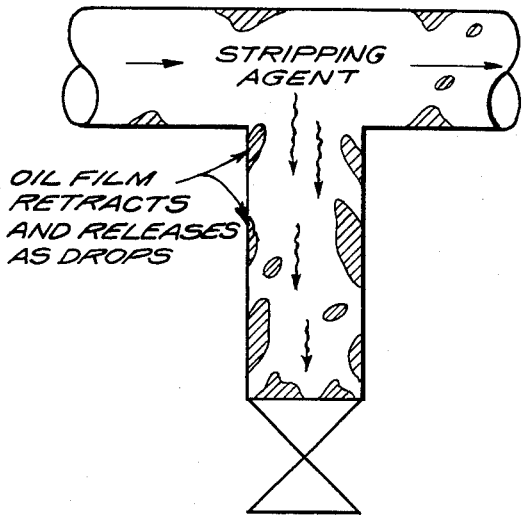
FIG. 2 is a pictorial illustration of the destruction of an oil film on a pipe system when such film is treated in accordance with the practice of the present invention.

It is postulated that the effectiveness of the method of the present invention is that the agent in the flushing fluid tends to cause the crude oil film present on the interior surface of the pipe system to "bead up" into droplets which are released from the surface into the surrounding water phase as is shown, for example, in FIG. 2. Thus, even in dead-ended pipe sections which cannot be flushed with water directly, soaking of that section with a solution of the hydrocarbon-stripping agent effectively frees the piping of residual hydrocarbon fluids thereby preventing subsequent discharge of hydrocarbon into the ballast water, for example.

In any event, in accordance with the practice of the present invention, it also is particularly preferred to pre-soak and pre-flush the pipe system with water prior to flushing with the aqueous solution of hydrocarbon-stripping agent. Additionally, it has been discovered that flushing for times in excess of about a half-hour have little added benefit. Consequently, it is preferable to use repeated flushings which do not exceed about a half-hour in time.

Obviously, the piping arrangements of oil tankers vary considerably from one class to another and, consequently, a specific detailed flushing procedure utilizing the method of the instant invention cannot be set forth in precise detail. Nonetheless, a summary of one preferred flushing procedure which is in accordance with the practice of the present invention is set forth hereinbelow as a useful guide for adoption and modification as necessary in actual field use.

General flushing procedure:

1. Completely drain all cargo from lines including crossovers, decklines, etc., before flushing or loading dirty ballast.
2. If possible, fill lines with water for a ½ hour to 1 day soaking period prior to first flush with water and normally leave pipe lines full with water between subsequent flushes.
3. Initially flush to the slop tank to remove most of the crude oil from the piping and pumps. To avoid oily discharge to sea, recirculate the flush water through the slop tank.
4. Flush lines at a high flow rate to promote complete turbulence. Flush each line separately, i.e., do no open parallel branch lines, in order to ensure high velocity in each section of piping. Flush each line for about a half-hour at a time, since beyond that period, little oil is removed.
5. Water flushing is most effective during the start-up of each flushing period. The pipes should be kept full of water between flushing periods, and this water should be drained as completely as possible from the lines just prior to commencing the next water flushing period in order to remove oil pockets from upward facing vertical dead-ends and to increase turbulence when initiating the next water flush.
6. To increase the flushing effectiveness in the pipe system, particularly in dead-end piping, flush with sea water containing from about 25 to 1000 ppm of a hydrocarbon-stripping agent herein before described and preferably containing from about 100 to 300 parts per million of hydrocarbon-stripping agent. The aqueous solution generally is used after at least 1 sea water flushing and preferably after 2 or 3 sea water flushes. The hydrocarbon-stripping agent can be added to fresh sea water at the pump section and recirculated through a washed slop tank. Alternatively, it may be poured directly into the washed slop tank or mixed with fresh sea water by recirculation. Flush each line in the pipe system with the stripping agent containing solution, pumping the solution through that line of the system for approximately 15 to 30 minutes. Allow the stripping agent solution to stay in the piping after the flushing period, preferably for up to about 1 to 4 days. Every effort should be made to assure that the solution contacts all sections of pipe. Recirculate before finally discharging the stripping agent containing solution to the slop tank. Thereafter, resume normal water flushing operations.

7. The aqueous solution is retained in the slop tank until an oil layer separates. This layer is then removed and blended with the next cargo.

In order to further demonstrate the subject invention, reference now is made to the following detailed examples.

EXAMPLE 1

The effectiveness of various hydrocarbon-stripping agents for improving the line flushing operations was determined in a series of screening tests in which dry rusty carbon steel strips and pipe sections were presoaked in crude oil and were then placed in sea water solutions containing candidate hydrocarbon-stripping agents. Oil release from the steel strips was observed under non-agitated conditions. Also, contact angle measurements of the oil film after a 24 hour soak with the candidate solution showed changes from 0° to about 50°. This angle change represents a change from complete oil wetting to only partial oil wetting; and, corresponding to this change, the film proceeded to retract ("bead-up") and release the oil as droplets. Typical results of these test are summarized in Table I below.

TABLE I

| Run No. | Oil-Stripping Agent Formulation (1) | HLB No. | Remarks |
|---|---|---|---|
| 1 | None | — | No oil release |
| 2 | Preferred agent (2) | — | Most effective |
| 3 | Blend "A" (3) | 6 | Effective |
| 4 | Sodium dioctyl sulfosuccinate | — | Less effective |
| 5 | Blend "B" (4) | 16 | Ineffective |

(1) In artificial sea water at 300 ppm.
(2) See Table II below.
(3) Blend of polyethylene oxide (20) sorbitan mono-oleate (17 wt %) and sorbitan mono-laurate (83 wt %).
(4) Blend of polyethylene oxide (20) sorbitan mono-oleate (40 wt %) and polyethylene oxide (20) sorbitan monolaurate (60 wt %).

TABLE II

| Component | % of Component (volume) | HLB No.(1) |
|---|---|---|
| Sorbitan mono-oleate | 12 | |
| Sorbitan mono-oleate with polyethylene oxide (20 mol) adducts | 22 | |
| Sorbitan tri-oleate with polyethylene oxide (20 mol) adducts | 33 | 11.1 |
| Sodium dioctyl sulfosuccinate | 33 | |

(1)For first three components; excludes sodium dioctyl sulfosuccinate.

EXAMPLE 2

Figure 3:
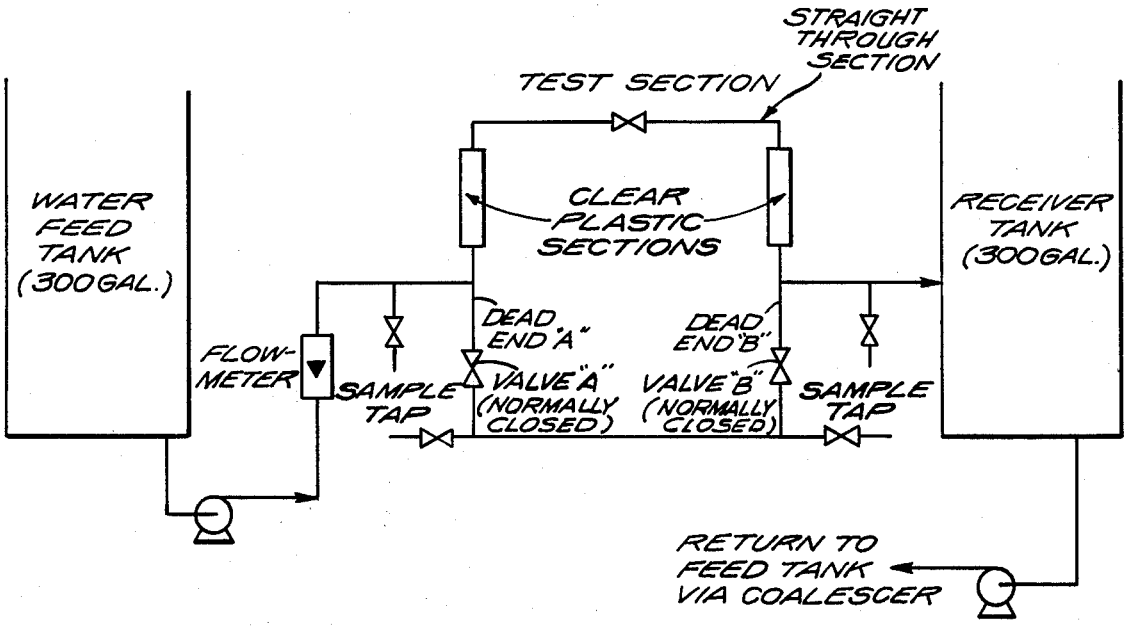
FIG. 3 is a schematic diagram of a laboratory system employed in demonstrating the present invention.

To evaluate line flushing techniques and hydrocarbon-stripping agents, the pipe loop of FIG. 3 consisting of interchangeable ¼" and ½" diameter, 6 foot long, carbon steel and clear plastic piping was constructed. The pipe loop included a feed tank, flow meters, a receiving tank and an oily water coalescer for clean-up and recycle of the flush water.

As can be seen in FIG. 3, one configuration of piping was carbon steel, except for the two vertical sections above the tee's. These two vertical sections were clear plastic which permitted observation of the hydrocarbon-stripping and flushing process. Sections of the piping were removable to permit analysis of oil content on the interior surfaces of the piping sections. As shown in FIG. 3, the piping configuration branched. This was to simulate branched tanker piping with dead end sections.

At the start of a run, the clean dried pipe loop was filled with crude oil for about an hour. After draining the oil, the pipe loop was then flushed with water for the number of times indicated in Table III which follow and for a period of about 30 minutes. In certain runs, as shown in Table I, the system was soaked for a specified period with a water solution containing 300 ppm of a hydrocarbon-stripping agent having the composition shown in Table II. Thereafter, the system was flushed with water. The time between flushing periods varied from a few hours to a few days. Samples of flushing water were taken at various times during each flushing period to monitor oil contamination in the flushing water. Additionally, after each run, the pipe loop was disassembled and the pipe sections were then flushed with a fluorocarbon solvent. Based on the amount of oil in the fluorocarbon solvent, the oil content in each section was determined.

Typical laboratory data, showing the oil content of the various pipe loop sections for a series of runs are shown in Table III below. The data show that the oil remaining in the dead-end sections and valves was considerably reduced through the use of a soaking period with a solution of a hydrocarbon-stripping agent. Observations of the clear plastic sections showed oil drops draining from the piping below the plastic sections within about 15 minutes of application of the hydrocarbon-stripping solution.

TABLE III

| | Test Summary of Oil Remaining in Pipe Loop After Flushing | | | | | | |
|---|---|---|---|---|---|---|---|
| | | | Oil Remaining in Pipe Loop Sections(1) | | | | |
| Run No. | No. of Water Flushes | Stripping Agent | Straight Through Flushed Pipe | Dead-end "A" | Dead-end "B" | Valve "A" | Valve "B" |
| 1 | None | None | 96 | 171 | 167 | 1987 | 2734 |
| 2 | One | None | 17 | 118 | 122 | 1459 | 1493 |
| 3 | Two | None | 13 | 90 | 75 | 838 | 1065 |
| 4 | Two | Yes(2) | 14 | 36 | 61 | 469 | 606 |
| 5 | Two | Yes(3) | 14 | 36 | 41 | 197 | 239 |

(1)Oil content in piping sections in milligrams per inch. Oil content in valves in milligrams.
(2)Soaked with 300 ppm water solution of hydrocarbon-stripping agent overnight.
(3)Soaked with 300 ppm water solution of hydrocarbon-stripping agent for 3 days.

The foregoing tests show the effectiveness of use of a hydrocarbon-stripping agent in destroying the oil film on the internal walls of the pipe system with essentially no agitation mixing energy and the increase in efficiency therefore of the overall water flushing operation.

The laboratory tests conducted also showed that for the most effective straight through flushing, the water flow rate should be well into the turbulent regime, preferably as turbulent as possible. This regime corresponds to the rate at which the flow friction factor (used in pressure drop calculations) begins to level out as the flow rate expressed (as a Reynolds number) is increased. As a rough guideline, therefore, it is recommended that tankers operate flushing pumps at greater than 50% maximum capacity to achieve highly turbulent conditions.

EXAMPLE 3

A shipboard evaluation of the flushing technique of the present invention was carried out during a 15 day leg of a ballast voyage of a commercial oil tanker. In this test, operations after crude discharge were carried out in the normal way with the exception that after the tanker pipe lines were water flushed twice, an aqueous sea water solution containing 300 parts per million of a hydrocarbon-stripping agent was circulated through the tanker piping once a day over a three day period. The agent used had the composition given in Table I. Two drums of the agent were mixed with 1400 tons of the sea water for this flushing operation. Most of the chemical was added at the cargo pump suction as sea water was pumped into a washed slop tank. The remainder was simply dumped into the tank from the deck. Samples were taken from both the slop tank and the piping to evaluate the effectiveness of each flush. Finally, samples were collected during a clean ballast trial discharge through the piping several days after the flushing operation with the aqueous hydrocarbon-stripping agent.

Analysis of the shipboard test samples taken during the trial clean ballast discharge confirmed observations that there was no visible oil at any time during this discharge.

Samples taken during the initial sea water flushing also confirmed laboratory observations that oil removal from pipe sections is high during the start of each flush and drops off significantly after about 30 minutes.

While the present invention has been described in particular detail in connection with removing oil films and oil remaining in tanker pipe lines after oil discharge, it should be readily apparent that this invention is applicable to cleaning pipe systems of residual amounts of hydrocarbons remaining in the systems after being used to contain and/or transfer said hydrocarbons and therefore reasonable variations and modifications of the subject invention are possible without departing from the spirit and scope thereof.

What is claimed is:

1. A method for removing residual hydrocarbon fluids from the internal surfaces of pipe systems comprising: contacting the residual hydrocarbon fluids with a water solution containing a hydrocarbon-stripping agent which is capable of decreasing the wetting characteristics of the residual hydrocarbon fluids on the internal surfaces of the pipe system whereby the hydrocarbon fluid retracts and forms droplets, said hydrocarbon-stripping agent being selected from the group consisting of (a) mixtures of sorbitan monoesters of $C_{10}$ to $C_{20}$ aliphatic carboxylic acids and polyoxalkylene adducts of the sorbitan monoesters wherein said mixtures have a HLB number in the range of from about 5 to about 9, (b) mixtures of sorbitan monoesters of $C_{10}$ to $C_{20}$ aliphatic carboxylic acids and polyoxalkylene adducts of the sorbitan monoesters having a HLB number in the range of from about 9 to 12 with dialkyl sulfosuccinate salts in amounts ranging from about 10% to about 40% by volume of the mixture, and (c) mixtures of either of the foregoing groups with up to 2 parts by volume of a paraffinic solvent and thereafter removing said residual hydrocarbon fluid droplets with the water solution.

2. The process of claim 1 wherein said water solution is a saline solution containing from about 25 parts to about 1000 parts per million of hydrocarbon-stripping agent.

3. The method of claim 2 wherein said water solution contains from about 100 parts per million to about 300 parts per million of stripping agent.

4. The method of claim 3 wherein said hydrocarbon-stripping agent is a mixture of sorbitan monoesters of $C_{10}$ to $C_{20}$ aliphatic carboxylic acids, polyoxalkylene adducts of the sorbitan monoesters including from about 10% to about 40% by volume of dialkyl sulfosuccinate salts.

5. The method of claim 4 wherein said mixture includes 30% to about 35% by volume of dialkyl sulfosuccinate salts.

6. The method of claim 5 wherein the hydrocarbon-stripping agent is a mixture of sorbitan monooleate, sorbitan monooleate with polyethylene oxide adducts, sorbitan trioleate with polyethylene oxide adducts having an HLB number of about 11 with from about 30% to 35% by volume of sodium dioctyl sulfosuccinate.

* * * * *